United States Patent [19]

Gilbert

[11] 4,361,958

[45] Dec. 7, 1982

[54] RETRACTABLE BLADE KNIFE

[75] Inventor: Richard Gilbert, Sheffield, England

[73] Assignee: Stanley Tools Limited, Sheffield, England

[21] Appl. No.: 203,337

[22] Filed: Nov. 3, 1980

[30] Foreign Application Priority Data

Nov. 19, 1979 [GB] United Kingdom ..... 7939977

[51] Int. Cl.[3] ..... B26B 1/08

[52] U.S. Cl. ..... 30/162; 30/320

[58] Field of Search ..... 30/162, 335, 336, 337, 30/320

[56] References Cited

U.S. PATENT DOCUMENTS 4,196,515 4/1980 Sugiyama ..... 30/162

4,200,977 5/1980 Kageyama ..... 30/320 X

*Primary Examiner*—James M. Meister

*Attorney, Agent, or Firm*—Prutzman, Kalb, Chilton & Alix

[57] ABSTRACT

The plastics handle 21 of a retractable blade knife 20, which also comprises a blade 22 and a blade-slider 23, is molded in one piece in a two-part molding tool 50 which can mold several such handles simultaneously. The handle has a series of wall portions, 39, 40, 27 and 43, 44, 28, 48 alternating with apertures 45, 46, 29, 49 and 41, 42, 30 along each side 25, 26 respectively, each wall portion on each side being directly opposite a respective aperture on the opposite side, so that molding tool portions 54, 55 of the molding tool can form the inside surfaces of the wall portions for guiding the blade. Wall portions 27 are formed by molding tool portions 56 with gaps 31 for passage of a manually operable part 32 of slider 23, and also act as detents for the slider.

3 Claims, 15 Drawing Figures

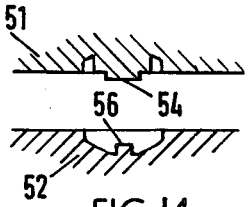
FIG. 14.
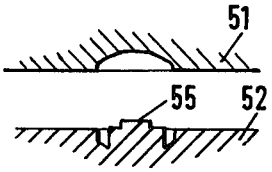
FIG. 15.
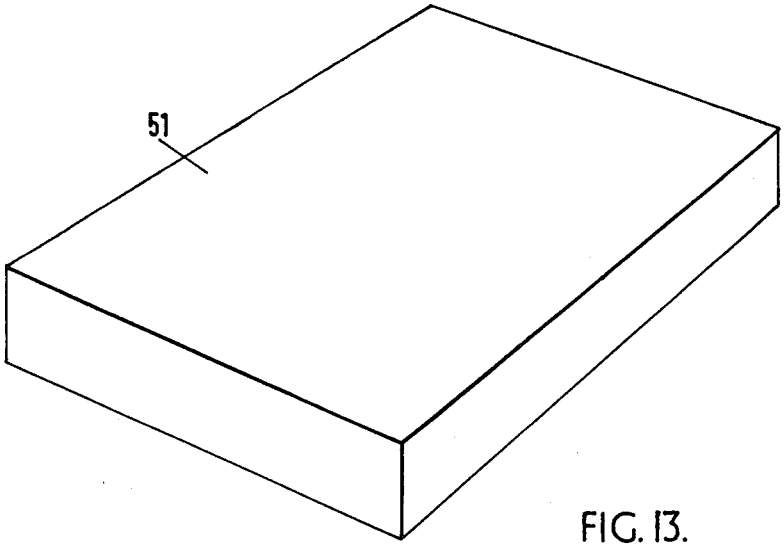
FIG. 13.
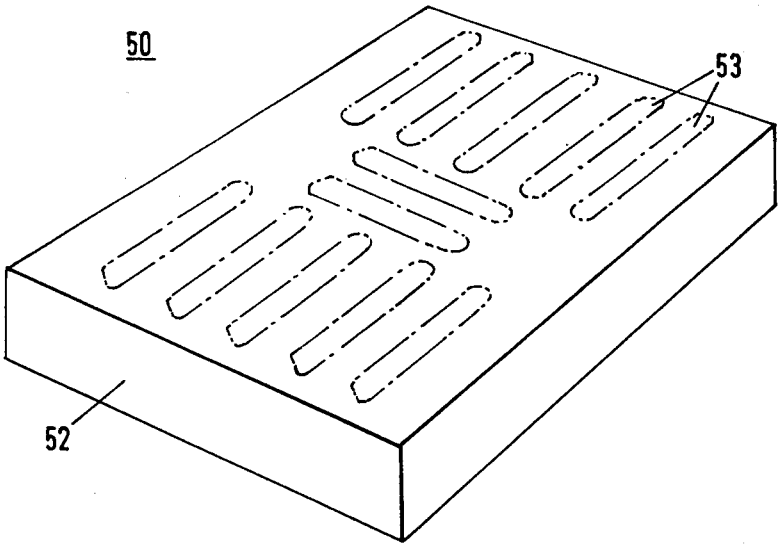

RETRACTABLE BLADE KNIFE

BACKGROUND OF THE INVENTION

1. Field of the Invention

This invention relates to a retractable blade knife comprising a handle, a blade and a blade-slider.

2. Description of the Prior Art

Known retractable blade knives, comprising an elongate handle with an internal channel extending therealong for the extension and retraction of a blade by means of a blade-slider, the blade being of a type adapted for successive portions thereof to be broken off and discarded when worn, have the handle made in two pieces or "halves" which can be separated or parted to open up the channel and re-assembled or put together again to close up the channel.

SUMMARY

It is an object of the invention to make a retractable blade knife comprising a handle, a blade and a blade-slider with the handle molded in one piece.

According to a first aspect of the invention there is provided a retractable blade knife comprising a handle, a blade and a blade-slider, the handle being in one elongate piece of molded material adapted for the slider to be detained in selectively different positions along the handle for extending and retracting the blade, which is adapted for successive portions thereof to be broken off and discarded when worn, characterised in that the handle is formed on each of two opposite sides with wall portions alternating with apertures, the wall portions on each side being directly opposite the apertures on the opposide side, the wall portions on one of said sides of the handle having gaps therein for the passage along the handle of a manually operable part of the slider, the wall portions on one of said sides of the handle forming detents for holding the slider in its selected position along the handle.

According to a second aspect of the invention there is provided a method of making the handle of a knife according to the first aspect of the invention, comprising the step of molding the handle in a two-part mold defining a longitudinally split mold cavity for the handle, each mold part having a series of portions for forming the apertures along a respective side of the handle and for forming inside surfaces of the wall portions along the opposite side of the handle, one mold part having a series of portions for forming said gaps.

BRIEF DESCRIPTION OF DRAWINGS

FIG. 13 is a perspective, partly diagrammatic view of a two-part mold for making several handles simultaneously, each like the handle of FIGS. 1 to 6; and FIGS. 14 and 15 are partial cross-sections through one of the handle cavities in the mold of FIG. 13 in different places.

DESCRIPTION OF PREFERRED EMBODIMENT

Figure 1:
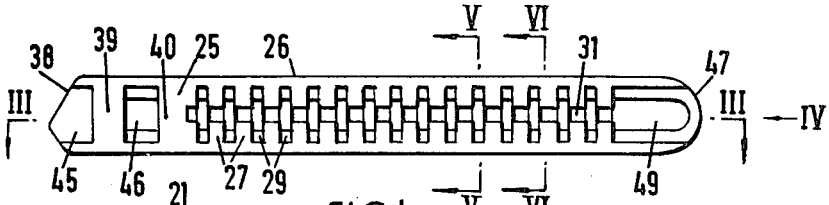
FIGS. 1 to 6 illustrate a handle of a preferred retractable blade knife embodying the invention, FIGS. 1 and 2 being opposite side elevations of the handle, FIG. 3 being a section on line III—III of FIG. 1, FIG. 4 being a view in the direction of arrow IV of FIG. 1 and FIGS. 5 and 6 being sections respectively on lines V—V and VI—VI of FIG. 1.
Figure 2:
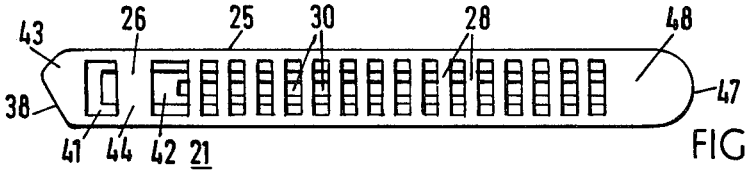
Figure 3:
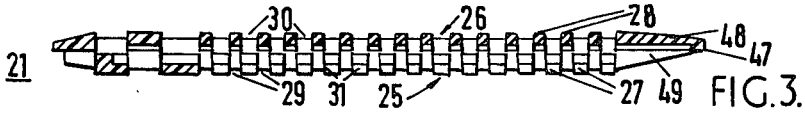
Figure 4:
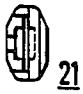
Figure 5:
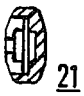
Figure 6:
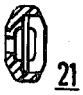
Figure 7:
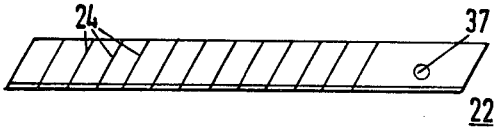
FIG. 7 is a side elevation of the blade of the knife embodying the invention.
Figure 8:
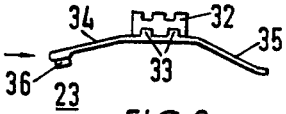
FIGS. 8 to 10 are respectively a side elevation, a plan view and an end view of the blade-slider of the knife embodying the invention.
Figure 9:
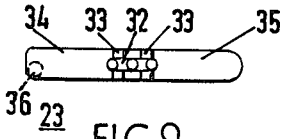
Figure 10:
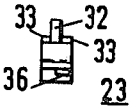

Referring to FIGS. 1 to 12, the illustrated retractable blade knife 20 comprises a handle 21 (FIGS. 1 to 6), a blade 22 (FIG. 7) and a blade-slider 23 (FIGS. 8 to 10).

The handle 21 is in one elongate piece of molded plastics material adapted for the slider 23 to be detained in selectively different positions along the handle 21 for extending and retracting the blade 22. The blade 22 is adapted for successive portions of the blade to be broken off and discarded when worn, by being provided with preformed breakage lines 24.

Figure 11:
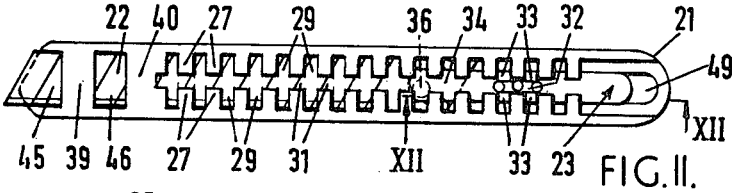
FIG. 11 is a side elevation of the knife in its assembled state.
Figure 12:
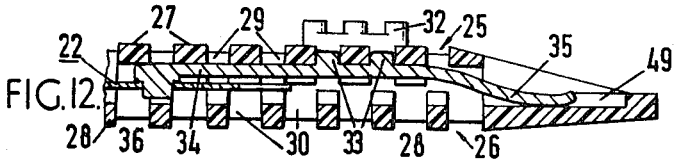
FIG. 12 is a section on line XII—XII of FIG. 11.

As shown in FIGS. 1 to 6, 11 and 12 the handle 21 is formed on each of two opposite sides 25 and 26 with wall portions 27 and 28 respectively alternating with apertures 29 and 30. The wall portions 27 and 28 on each side 25 and 26 are directly opposite the apertures 30 and 29 on the opposite side 26 and 25 respectively. That is to say, the wall portions 27 are directly opposite the apertures 30 whilst the wall portions 28 are directly opposite the apertures 29. The wall portions 27 have gaps 31 therein for the passage along the handle of a manually operable part 32 (FIGS. 8 to 10) of the slider 23. The same wall portions 27 also form detents for holding the slider 23 in its selected position along the handle 21. For this purpose, the slider 23 has two projections 33 on each side of the manually operable part 32. These projections 33 are engageable in the apertures 29, in between the wall portions 27, as shown in FIGS. 11 and 12. Two cantilever arms 34 and 35 of slider 23 are self-biased downwardly as seen in FIGS. 8 and 12, to urge the manually operable part 32 upwardly so that it protects above the wall portions 27 on sides 25 as shown in FIG. 12. The cantilever arm 34 carries a projection 36 that engages in a hole 37 in blade 22 for extending and retracting the blade 22.

At the front end 38 of the handle 21, there are two gapless wall portions 39 and 40, respectively directly opposite apertures 41 and 42 on side 26. Similarly, on side 26 there are two wall portions 43 and 44, respectively directly opposite apertures 45 and 46 on side 25. The inside surfaces of wall portions 39, 40, 43 and 44, respectively visible through the apertures 41, 42, 45 and 46 in FIGS. 1 and 2, engage the side surfaces of the blade 22 to hold the blade 22 firmly at the front end 38 of the handle during use. Further back along the handle 21, the inside surfaces of the wall portions 27 and 28, respectively visible through apertures 29 and 30 in FIGS. 1 and 2, also engage the blade 22 to assist in holding it firmly during use.

At the rear end 47 of handle 21, there is a wall portion 48 on side 26, opposite an aperture 49 on side 25.

It will be seen from the drawings that wall portions 27 are slightly longer (longitudinally of the handle 21) than wall portions 28, whilst wall portions 39, 40, 43 and 44 at the front end 38 of handle 21 are longer still and wall portion 48 being longer than any of the other wall portions. It will also be realised from a study of FIGS. 1 to 6 that the inside surfaces (which engage the blade 22) of all the wall portions 27, 28, 39, 40, 43, 44 and 48 are all respectively accessible, for purposes of being molded in a molding tool, through the opposite apertures 29, 30, 41, 42, 45, 46 and 49. Furthermore, as shown in FIG. 12 wall portions 27 and 28 are outwardly tapered in order to facilitate separation of the handle 21 from the molding tool after molding. Wall portions 39, 40, 43, 44 and 48 are similarly outwardly tapered for the same reason.

Referring to FIGS. 13 to 15, a two-part molding tool 50, comprising molding-tool parts 51 and 52, can be used for molding several handles 21 simultaneously in respective cavities 53. FIG. 13 is, it will be realised, largely diagrammatic and does not, for example, show the usual sprues which would be needed for conducting molten plastics material to each of the cavities 53. As shown in FIGS. 14 and 15, each mold part 51 and 52 has a series of portions 54 and 55 respectively for forming apertures 30 and 29 respectively in the handle 21. These same portions 54 and 55 also respectively form the inside surfaces of wall portions 27 and 28. Mold part 52 also includes a series of portions 56, respectively directly opposite portions 54 of molding tool part 51, for forming the gaps 31 in wall portions 27.

The principal advantage of the above-described handle 21 is that a single molding operation is all that is required to produce the complete one-piece handle 21, complete with the channel for the blade and the detents for the slider. Moreover, the same two-part molding tool can be used for molding several handles simultaneously, even though the knife 20 is a retractable blade knife, so that the handle is more complicated than the handle of a knife designed simply to hold a blade in a fixed position at one end.

The handle 21 may be made (molded) in die-cast metal instead of molded plastics material, using the same two-part molding tool 50 or one modified slightly for the different material. Hence "molding" includes die-casing. Other materials are also possible.

I claim:

1. A retractable blade knife comprising a handle, a blade and a blade-slider, the handle being in one elongate piece of molded material adapted for the slider to be detained in selectively different positions along the handle for extending and retracting the blade, which is adapted for successive portions thereof to be broken off and discarded when worn, characterised in that the handle is formed on each of the two opposite sides with wall portions alternating with apertures, the wall portions on each side being directly opposite the apertures on the opposite side, the wall portions on one of said sides of the handle having gaps therein for the passage along the handle of a manually operable part of the slider, the wall portions on one of said sides of the handle forming detents for holding the slider in its selected position along the handle.

2. A knife as claimed in claim 1 wherein the detent-forming wall portions are the wall portions having the gaps therein.

3. A knife as claimed in claim 1 or 2 wherein each said wall portion is outwardly tapered.

* * * * *